United States Patent [19]

Bergeron

[11] Patent Number: 4,474,308

[45] Date of Patent: Oct. 2, 1984

[54] TABLET EJECTOR

[76] Inventor: Michel Bergeron, 4921 Lafontaine St., Montreal, Canada, H1V 1R6

[21] Appl. No.: 428,718

[22] Filed: Sep. 30, 1982

[51] Int. Cl.[3] ..... G07F 11/52

[52] U.S. Cl. ..... 221/24; 221/79; 221/152; 221/197; 221/271; 273/129 S; 604/59

[58] Field of Search ..... 206/528, 537; 221/24, 221/69, 76, 79, 87, 88, 151, 152, 197, 198, 209, 271, 268; 222/78, 79, 336; 273/69, 129 S, 129 T; 604/59, 60, 61, 62, 63, 64

[56] References Cited

U.S. PATENT DOCUMENTS

| | | | |
|---|---|---|---|
| 842,631 | 1/1907 | Deperdussin | 604/62 |
| 2,294,001 | 8/1942 | Ritter . | |
| 2,354,402 | 7/1944 | Petruccione et al. | 222/78 |
| 2,632,444 | 3/1953 | Kas | 604/63 X |
| 2,718,299 | 9/1955 | Atwater et al. . | |
| 2,907,327 | 10/1959 | White . | |
| 4,060,083 | 11/1977 | Hanson . | |
| 4,174,048 | 9/1979 | Volpe, Jr. . | |

*Primary Examiner*—Joseph J. Rolla
*Assistant Examiner*—Lawrence J. Miller

[57] ABSTRACT

A tablet or pill ejector is disclosed consisting of at least three detachably secured sections in the general shape of a pen. The front end of the device is provided with a hole communicating with axially aligned bores formed longitudinally in the sections and through which a pill may be ejected quickly. An ejector rod is provided in the bores adapted to move from a cocked position to a released position wherein it passes instantly through a pill retaining member located in the front section of the device. Cocking and trigger mechanisms are provided. In an alternate embodiment the front section is provided with a revolvable barrel adapted to contain a plurality of pills for ejection. The rear end of the device may be provided with a storage compartment and cap.

3 Claims, 9 Drawing Figures

TABLET EJECTOR

FIELD OF THE INVENTION

The present invention relates to a tablet and pill ejecting device, more specifically to a novel and improved device of such type which is adapted to eject a pill or tablet very quickly as the need arises.

BACKGROUND OF THE INVENTION

Ordinarily medication in the form of pills and tablets are taken orally and are brought to the mouth by hand. Most pills can be given or self-administered in this way without any problem. However, in some cases, such medication must be taken very quickly to alleviate a crisis. For example persons who have a history of cardio-vascular illness carry anti-cardiac arrest pills with them at all times because, in case another heart attack strikes, the pills must be placed very quickly under the tongue. Till now such medication has been carried in small containers. This is unsatisfactory because a victim of a heart attack loses coordination and may also become very nervous. Consequently, due to fumbling, the pills may fall to the ground and the cardiac arrest may prove fatal.

In the domain of verterinary medicine it is often necessary to give one or more pills to a sick animal. This is often difficult since both hands must be used to open the animal's mouth, the latter then held open with one hand while the other places the pill in the mouth. When such a procedure is not done quickly enough the animal struggles and/or bites.

Accordingly the present invention pertains to an improved pen-shaped implement designed to place at least one pill very quickly in the mouth of a person or animal.

A number of U.S. patents teach the use of tablet or pill dispensers and for reference attention is hereby drawn to U.S. Pat. Nos. 4,060,083 and 4,174,048.

OBJECTS OF THE INVENTION

In view of the above it is a first object of the present invention to provide a tablet ejector in the general shape of a pen having an open end through which a tablet or pill may be ejected instantly by simply pressing the device's shirt pocket clip.

It is another object of the present invention to provide a tablet or pill ejector which can eject a plurality of pills rapidly one after the other in the above-described manner.

It is still another object of the present invention to provide a tablet ejector which has a compartment for a supply of pills.

It is yet another object of the present invention to provide a tablet ejector which has a simple design and is made of low-cost materials.

SUMMARY OF THE INVENTION

The above and other objects and advantages of the present invention are realized according to preferred embodiments comprising a cylindrical member made in at least three sections adapted to be detachably secured together. The front section is formed with a central and longitudinally extending bore, having a forward end opening which is placed in the mouth of the patient or animal to be treated and a rear end having a countersunk hole adapted to removably receive a pill retaining means. This rear end is also detachably secured to a middle section.

The latter also has a forward end and a rear end. The forward end and forward portion are provided with a longitudinally extending bore of the same diameter as the bore of the front section which is axially aligned with the same. The rear portion of the middle section is formed with a cavity of much larger diameter than the bore and the extreme rear portion is formed with a second bore of slightly larger diameter than the first bore.

The middle section is in turn detachably secured at its rear to the forward end of a third or rear section which has a longitudinally extending third bore of the same diameter as the second bore and is axially aligned therewith.

An ejector rod is located within the middle and rear sections and is adapted to slide longitudinally in the first bore, the cavity and the second and third bores between a first cocked position and a second released position wherein its front end extends through the pill retaining means. It will be appreciated that the ejector rod is of a sufficiently small diameter to make a close sliding fit in the first and second bores.

The mid-portion of the ejector rod is formed with an orthogonal and outwardly extending cocking arm which is adapted to slide longitudinally, being rigidly secured to the ejector rod. The outer end of the arm protrudes through a longitudinal slit formed in the second section.

The device further includes a trigger means for the swift release of the ejector rod from its cocked position. The trigger means is activated by a pocket clip which is slightly flexible and rigidly secured to the exterior surface of the device. A small inwardly directed pressure on the forward end of the clip pushes the latter into a small slit in the exterior surface of the device which in turn activates the trigger means, releasing the ejector rod.

Further provided is a biasing means for the ejector rod which causes the latter to forcefully hit the pill retaining means when the trigger means is activated without damaging the pill retained in the pill retaining means. Thus the pill is ejected through the front opening of the device almost instantly.

An alternate embodiment of the invention is also envisioned wherein a plurality of pills or tablets can be ejected one after the other in rapid succession. To accomplish such an action the first or front section of the device and its associated pill retaining means are replaced by an alternate front section which is provided with a revolvable barrel. The barrel has a plurality of circularly spaced-apart small holes each of which constitutes a pill retaining means. Axial means are provided to removably retain the barrel in the alternate front section. The latter is provided with a longitudinal bore and front opening as in the main embodiment. The barrel is adapted to be rotated by hand until one of the holes comes into registry with the bore. Stop means are provided to ensure that the barrel does not continue to revolve once one of the holes is properly aligned with the bore.

As a further useful feature of the invention the device can be provided with a compartment containing a plurality of pills which may be easily opened and a pill extracted therefrom can be loaded in the pill retaining means or barrel whereby the device is ready for any emergency or sudden need.

BRIEF DESCRIPTION OF THE DRAWINGS

The above will be more clearly understood by having referral to the preferred embodiments of the invention, illustrated by way of the accompanying drawings, in which.

DETAILED DESCRIPTION OF THE INVENTION

Figure 1:
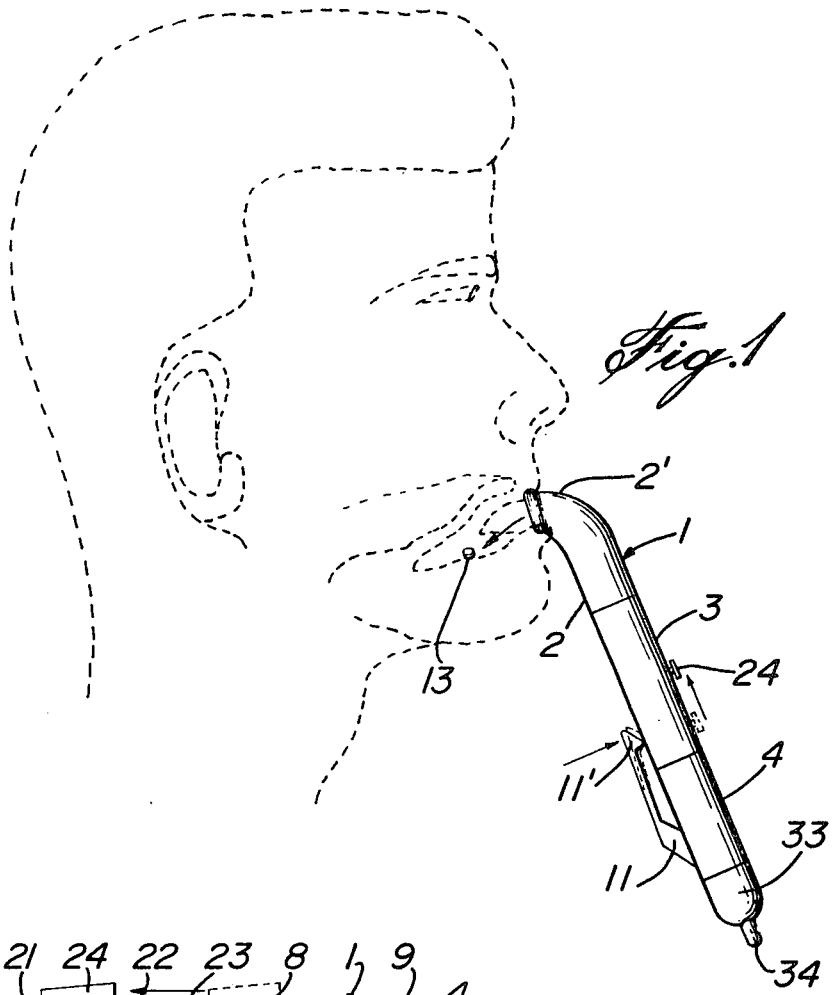
FIG. 1 is a side elevation of the pill ejector also showing in dashed outline the head of a user, also showing in solid line the front portion of the device placed in ejecting position under the tongue.

The tablet ejector 1 is generally in the shape of a pen and is made of at least three sections, a front section 2, a middle section 3 and a rear section 4. The front section 2 is curved laterally at its front end 2'. The latter is provided with a hole 2''.

The hole 2'' communicates with a central and longitudinally-extending bore 5 which is round in cross-section.

The rear end of front section 2 is formed with a threaded countersunk opening which is adapted to receive a removable pill retaining means 6 whose function is described below.

The front end of middle section 3 is detachably secured to the rear end of front section 2 in a suitable known manner. (As shown in the drawings the sections are screwed together). The front portion 3' of section 3 is provided with a bore 7 having the same diameter as bore 5 and is axially aligned therewith. The rear portion 3' of section 3 is provided with a large diameter cavity 8 while the extreme rear portion of section 3 is formed with a bore 9 of slightly larger diameter than bores 5 and 7. Bore 9 communicates with the cavity 8.

The front end of rear section 4 is also detachably secured to the rear end of section 3 by means of male and female threading as shown clearly in the drawings.

The major portion of rear section 4 has a longitudinal bore 10 of the same diameter as bore 9 of middle section 3.

A standard pocket clip 11 is rigidly secured to rear section 4 on its outer surface and is slightly flexible, extending frontwardly such that its front end 11'; overlies the rear portion of middle section 3.

Figure 3:
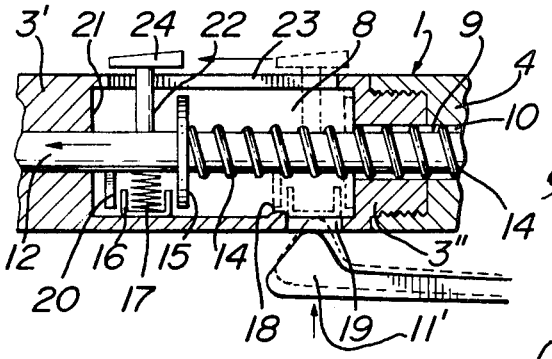
FIG. 3 is an enlarged longitudinal section of the middle section, showing the ejector rod in released position.
Figure 2:
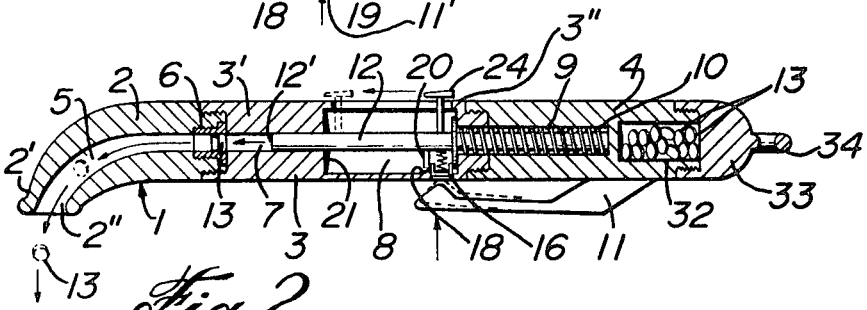
FIG. 2 is a longitudinal section, showing the ejector rod in cocked position.
Figure 4:
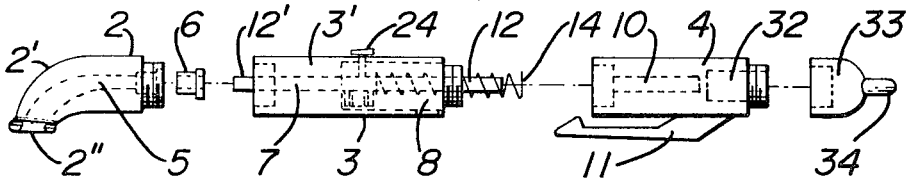
FIG. 4 is an exploded side view of the device.
Figure 5:
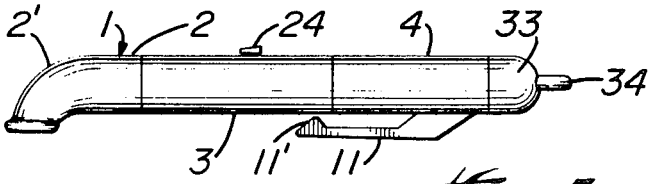
FIG. 5 is a side view of the device.
Figure 6:
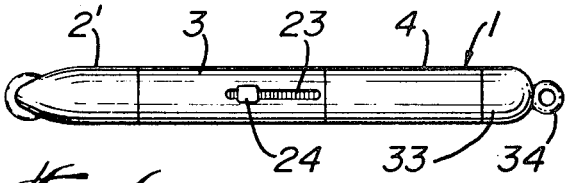
FIG. 6 is a top view of the device.
Figure 7:
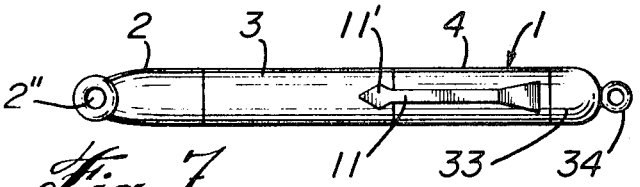
FIG. 7 is a bottom view of the device.
Figure 8:
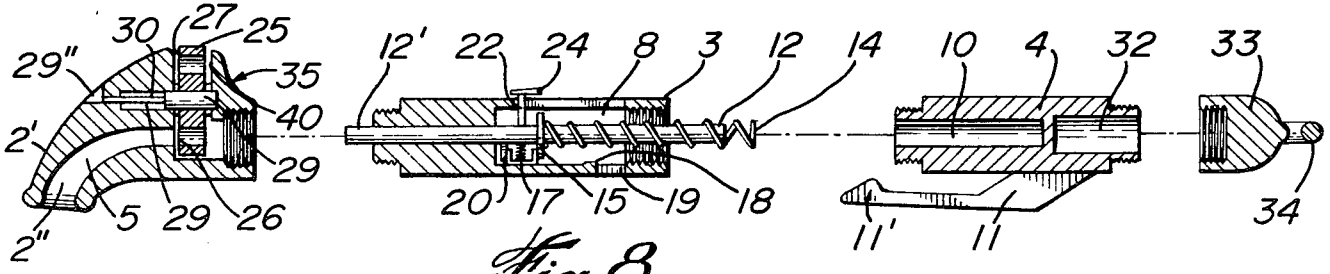
FIG. 8 is an exploded and longitudinal section of the device according to an alternate embodiment of the invention.

The tablet ejector 1 is provided with an ejecting and cocking mechanism as described herebelow and comprising: an ejector rod 12 made of suitably rigid material such as hard plastic. Rod 12 is adapted to slide longitudinally in bores 5, 7, 9 and 10 between a first cocked position (shown in FIG. 2) wherein its front end 12' is located rearwardly of the pill retaining means 6 and a second released position (as shown in FIG. 3) wherein the front end 12' has passed through the pill retaining means 6 and is located forwardly of the same in bore 5.

It will be readily appreciated that ejector rod 12 moves with sufficient velocity to forcefully impact on a pill or tablet 13 loaded in the pill retaining means 6 thus ejecting pill 13 through the front opening 2''. Yet rod 12 does not move switfly enough to damage the pill.

To accomplish this action of rod 12, forward biasing means are provided, consisting of a coil spring 14 located around the rear portion of ejector rod 12 and having one end abutting against the rear wall of bore 10. The other end of spring 14 abuts against a circular plate 15 rigidly secured to the approximate middle of rod 12 and adapted to move in cavity 8. Spring 14 is compressed when ejector rod 12 is in the cocked position.

A trigger means is also provided to release rod 12 in a simple and effective manner. The former consists of the following elements: a U-shaped foot 16 movably secured to rod 12 and biased downwardly therefrom by a second small coil spring 17 which is secured to the lower surface of rod 12 and to foot 16. The bottom surface of the latter is adapted to slide along the bottom surface of cavity 8, in constant contact therewith. It is located immediately forwardly of plate 15. A small protuberance 18 is integrally formed in the lower surface of cavity 8 and is adapted to retain foot 16 in the cocked position by preventing any forward movement thereof.

Immediately rearwardly of protuberance 18 a small slit 19 is formed in the wall of middle section 3. When rod 12 is in cocked position foot 16 overlies slit 19. As shown clearly in FIG. 3 of the drawings forward end 11' of pocket clip 11 is exactly opposite slit 19. Thus when end 11' is pressed through the slit 19 it raises foot 16 above protuberance 18, releasing rod 12 forward under the action of spring 14. To limit the forward movement of rod 12 a tab 20 is provided, being rigidly secured to the latter forwardly of foot 16. Tab 20 thus hits the front wall 21 of cavity 8. Tab 20 and plate 15 retain U-shaped foot 16 therebetween.

To recock rod 12 cocking means are also provided in the device, consisting of an orthogonally projecting arm 22 also rigidly secured to rod 12 but diametrically opposite foot 16. The upper end of arm 22 extends through a longitudinally-extending slit 23 formed in the wall of middle section 3 and has a topmost finger pad 24. A rearward pushing action on this pad 24 serves to move ejector rod 12 rearwardly until foot 16 falls into place behind protuberance 18. As mentioned above an alternate embodiment is envisioned wherein the front section 2 is replaced by a modified version 35. This version also has a laterally curved front end 2' and a hole 2''. The latter communicates with a bore 5.

Figure 9:
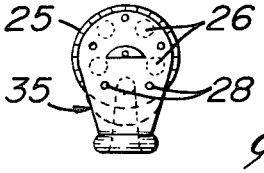
FIG. 9 is a front end view of the alternate front section of the device Like numerals refer to like elements throughout the drawings.

Instead of a single pill retaining means the alternate embodiment of the front section is provided with a revolvable barrel 25 having a longitudinal axis. Barrel 25 is formed with a plurality of holes 26 (five are shown in FIG. 9), each adapted to contain a pill and is rotated by hand until one of the holes 26 becomes aligned with bore 5. Lock means are provided to keep barrel 25 from further rotation once a hole 26 is thus aligned consisting of a small protuberance 40 formed in one side of the aperture 27 in which barrel 25 is located. This protuberance is adapted to snap into one of a plurality (corresponding to the number of holes 26) of indentations 28 which are radially spaced-apart in one face of barrel 25.

Means are provided to remove the barrel for reloading consisting of a straight and rigid pin 29 the rear portion forms an axle for barrel 25. Forwardly of the axle portion, member 29 is of a much smaller diameter and slides in a channel 30 formed in front section 35. The forward end of member 29 is formed with a small tab 29'' adapted to be pulled out by the fingers of a user. The axle portion then slides into channel 30 until its front end abuts against the forward wall of channel 30, releasing barrel 25 for removal and reloading.

An added but not essential feature of the present invention is a compartment 32 made in the rear portion of rear section 4 containing a plurality of pills 13. A cap 33 is provided and is adapted to be screwed or otherwise secured to rear section 4. As a carrying convenience a ring member 34 is secured to cap 33.

What I claim is:

1. A tablet ejector generally in the shape of a pen and comprising at least three sections: a front section, a middle section and a rear section; said front section having a first central and longitudinal bore and at least one pill retaining means at the rear end thereof; said middle section having a front portion provided with a second longitudinal bore in axial alignment with said first bore; a cavity located rearwardly of said second bore, said rear section having a longitudinal third bore axially aligned with said first and second bores; said third bore is of slightly larger cross-sectional area than said first and second bores; an ejector rod slidable longitudinally in said first, second and third bores between a first rearward cocked position and a second released front position wherein the front end of said ejector rod has passed through said pill retaining means; a circular plate rigidly secured to said ejector rod and extending within said cavity, a coil spring having one end abutting the rear wall of said third bore and the other end abutting said circular plate; said coil spring surrounding said ejector rod, a foot carried by said rod and located immediately forwardly of said circular plate in said cavity and radially outwardly biased therein by a second coil spring; a protuberance formed in the inner surface of said cavity and adapted to retain said foot in said cocked position; a small slit made in the wall of said middle section immediately rearwardly of said protuberance; a pocket clip rigidly secured to the exterior wall of the device and having a forward end overlying said slit and being slightly flexible, whereby said forward end can be pressed into said slit to release said foot and said ejector rod.

2. A tablet ejector as defined in claim 1, wherein said front section is provided with a revolvable barrel having a longitudinal axis; said barrel being provided in turn with a plurality of radially spaced-apart holes, each constituting a pill retaining means; lock means to prevent further movement of one of said holes when it comes into registry with said first bore; and means to remove said barrel for reloading wherein the reloading means consists of a straight and rigid member having a rear portion serving as an axle for said revolvable barrel; the forward portion of said member being of smaller diameter and adapted to slide in a frontward channel formed in said front section; said member further having a forward end which can be grasped by the fingers of a user and pulled forwardly to free said barrel for removal.

3. A tablet ejector as defined in claim 1 wherein the rear portion of said rear section is formed with a compartment and a detachable cap is provided to close the latter, whereby a supply of pills can be conveniently stored in the device.

* * * * *